US008726921B2

(12) United States Patent
Wilkins

(10) Patent No.: US 8,726,921 B2
(45) Date of Patent: May 20, 2014

(54) UMBRELLA

(76) Inventor: Cindy A. Wilkins, Ringgold, GA (US)

( * ) Notice: Subject to any disclaimer, the term of this patent is extended or adjusted under 35 U.S.C. 154(b) by 250 days.

(21) Appl. No.: 13/096,498

(22) Filed: Apr. 28, 2011

(65) Prior Publication Data

US 2011/0265836 A1 Nov. 3, 2011

Related U.S. Application Data

(60) Provisional application No. 61/328,798, filed on Apr. 28, 2010.

(51) Int. Cl.
*A45B 19/08* (2006.01)
*A45B 17/00* (2006.01)
*A45B 11/00* (2006.01)

(52) U.S. Cl.
USPC ..... 135/25.4; 135/20.1

(58) Field of Classification Search
USPC ..... 135/15.1, 25.1, 25.4, 20.1, 16
See application file for complete search history.

(56) References Cited

U.S. PATENT DOCUMENTS

| | | | | | |
|---|---|---|---|---|---|
| 1,587,475 | A | * | 6/1926 | Davis | 135/26 |
| 3,304,035 | A | * | 2/1967 | Davis | 248/516 |
| 3,765,434 | A | * | 10/1973 | Riggs | 135/20.1 |
| 4,543,971 | A | | 10/1985 | Sirota | |
| 4,562,849 | A | | 1/1986 | Sirota | |
| 5,150,728 | A | | 9/1992 | Stark | |
| 5,287,871 | A | | 2/1994 | Trice | |
| 5,385,161 | A | | 1/1995 | Loker et al. | |
| 5,529,368 | A | | 6/1996 | Cui et al. | |
| 5,727,583 | A | | 3/1998 | Kennedy | |
| 5,836,327 | A | * | 11/1998 | Davis | 135/16 |
| 5,848,831 | A | * | 12/1998 | Tatsumi | 362/102 |
| 5,850,843 | A | | 12/1998 | Mahood et al. | |
| 5,890,506 | A | * | 4/1999 | Kupferman | 135/33.2 |
| 5,921,259 | A | | 7/1999 | Ehler | |
| 6,213,137 | B1 | | 4/2001 | Wang | |
| D446,005 | S | | 8/2001 | Be Lue | |
| 6,722,380 | B1 | | 4/2004 | Hafer | |
| 6,959,715 | B2 | | 11/2005 | Siegel | |
| 7,631,654 | B2 | * | 12/2009 | Blumenthal et al. | 135/16 |
| 2002/0074027 | A1 | * | 6/2002 | Maidment | 135/16 |
| 2002/0139403 | A1 | | 10/2002 | Shi | |
| 2006/0272688 | A1 | * | 12/2006 | McWhorter et al. | 135/16 |
| 2007/0133191 | A1 | * | 6/2007 | Ma | 362/102 |
| 2010/0071737 | A1 | * | 3/2010 | Gourdine et al. | 135/16 |

* cited by examiner

*Primary Examiner* — David R Dunn
*Assistant Examiner* — Danielle Jackson
(74) *Attorney, Agent, or Firm* — Crose Law LLC; Bradley D. Crose

(57) ABSTRACT

An umbrella is disclosed. In one embodiment, the umbrella includes an extensible, collapsible handle adapted to interchangeably secure the umbrella to a surface to allow for hands-free operation while a user is beneath the umbrella in order to remain dry and shaded. In at least one embodiment, the umbrella includes a retractable, magnetic attachment device in the handle. The umbrella includes a multiplicity of angle, pivot, and rotation configurations for use. The umbrella is adapted to pivot and bend in various locations. The umbrella provides for hands-free use when mounted. It at least one embodiment, the umbrella includes one or more of a shaft light and a frame light to provide illumination.

17 Claims, 10 Drawing Sheets

UMBRELLA

CROSS-REFERENCE TO RELATED APPLICATION(S)

The present non-provisional patent application claims the benefit of priority of U.S. Provisional Patent Application No. 61/328,798, which is entitled "UMBRELLA", which was filed on Apr. 28, 2010, and which is incorporated in full by reference herein.

FIELD OF THE INVENTION

The technology described herein relates generally to portable umbrellas and shades. More specifically, this technology relates to an umbrella with an extensible, collapsible handle adapted to interchangeably and temporarily secure the umbrella to a surface in order to allow for the hands-free operation of the umbrella while a user is, for example, beneath the umbrella in order to remain dry and shaded. Furthermore, this technology relates to an umbrella adapted with a multiplicity of angle, pivot, and rotation configurations for varied use and adaptation. Still furthermore, this technology relates to an umbrella providing illumination, upwardly from a shaft light and downwardly from a frame light.

BACKGROUND OF THE INVENTION

Umbrellas, such as traditional hand-held, collapsible umbrellas, are known in the background art and are nearly ubiquitous. Such an umbrella typically is utilized by the bearer to provide protection from the rain or sun while the bearer maintains a hold on the handle of the umbrella. However, numerous practical and ergonomic issues exist with these known devices.

By way of example, use of such an umbrella while loading a child into a car seat is problematic when both hands are needed by the caregiver to load the child into the car seat, yet all the while it is desired to have one hand to hold the umbrella. Similarly, difficulty in umbrella use occurs when loading groceries or shopping bags into a trunk, aiding a handicapped person with entry into a vehicle, loading luggage into a vehicle, and other like circumstances when more than one hand is required for a given task, yet one hand also is required to hold the umbrella.

Related utility and design patents and published patent applications known in the art include the following: U.S. Pat. No. 4,562,849, issued to Sirota on Jan. 7, 1986, discloses an umbrella unit and car and the like provided therewith. U.S. Pat. No. 6,213,137, issued to Wang on Apr. 10, 2001, discloses an umbrella opening device for a vehicle. U.S. Pat. No. 5,921,259, issued to Ehler on Jul. 13, 1999, discloses a portable shade for a vehicle. U.S. Pat. No. 5,850,843, issued to Mahood et al. on Dec. 22, 1998, discloses an umbrella supported by a vehicle wheel. U.S. Pat. No. 5,529,368, issued to Cui et al. on Jun. 25, 1996, discloses an umbrella unit attachable to a vehicle. U.S. Pat. No. 4,543,971, issued to Sirota on Oct. 1, 1985, discloses an umbrella holder. U.S. Pat. No. 6,722,380, issued to Hafer on Apr. 20, 2004, discloses an umbrella support for use with a vehicle having a hitch receiver. U.S. Pat. No. 5,287,871, issued to Trice on Feb. 22, 1994, discloses a vehicle sun shade. U.S. Pat. No. 6,959,715, issued to Siegel on Nov. 1, 2005, discloses an umbrella for a departing auto passenger. U.S. Pat. No. 5,150,728, issued to Stark on Sep. 29, 1992, discloses an umbrella having magnet fasteners. U.S. Pat. No. 5,385,161, issued to Loker et al. on Jan. 31, 1995, discloses an umbrella support. U.S. Pat. No. 5,727,583, issued to Kennedy on Mar. 17, 1998, discloses a service umbrella.

Related design patents known in the art include the following: U.S. Pat. No. D446,005, issued to Be Lue on Aug. 7, 2001, discloses the ornamental design for a car umbrella holder.

Related published patent applications known in the art include the following: U.S. Patent Application Publication No. 2002/0139403, filed by Shi and published on Oct. 3, 2002, discloses an automobile umbrella.

SUMMARY OF THE INVENTION

In various exemplary embodiments, the technology described herein provides a lightweight, portable umbrella with an extensible, collapsible, and retractable handle and attachment device folded out from within adapted to interchangeably secure the umbrella to a surface to allow for hands-free operation while a user is beneath the umbrella in order to remain dry and shaded. The umbrella can be manufactured in a multiplicity of sizes.

The umbrella includes a durable, lightweight shaft supporting a rib structure. In at least one embodiment, the shaft itself is extensible and retractable. Additionally, the shaft can vary in length to produce umbrellas of varying lengths or heights.

The shaft is manufactured of a durable material sufficient to support the rib structure and shade. The rib structure is adapted to support one or more shades or canopies. The rib structure and canopy are collapsible. The canopy or shade can vary in size, shape, and number.

By way of example, the shade can be of a smaller diameter when extended to accommodate a child. The shade can be of a larger diameter when extended to accommodate a taller adult or even multiple persons.

Additionally, the shade, in at least one embodiment, includes a ventilation portion. The ventilation portion is, for example, a mesh like material with holes near the top portions of the shade, closest to the shaft. In such an embodiment, an upper tier shade can cover the ventilation area. Furthermore, the shade can include ventilation holes in order to allow passage of air, such that the shade still provides cover from rain and wind, yet wind passes through the ventilation holes so as to not blow the umbrella away.

The umbrella includes at least one pivot and/or rotation point that allows for a pivot in a two-dimensional plane, or rotation in a three-dimensional plane. In various embodiments, multiple pivot/rotation points are utilized.

The umbrella includes a handle that is retractable from the shaft. As the handle is retracted, a connector joint and attachment device, such as a magnet, is revealed. The magnet is utilized, for example, to temporarily secure the umbrella to a metallic surface such as one on a car to allow for the hands-free operation of the umbrella by a user.

Alternative attachment devices, in addition to magnets, to retract from the handle are anticipated. By way of example, in at least one embodiment, a suction attachment is used. Additionally, in at least one embodiment, the shaft is extensible by means of an internal rod which can be ejected to a certain length by the bearer of the umbrella. The extensibility in length can vary as selected by the user.

The retraction of the handle, connector joint, and attachment device provides additional pivot capabilities and angles of use for the umbrella once mounted. The umbrella is designed to be used in a multiplicity of directions, angles, pivots, rotations, and the like, as selected by a user to allow the desired coverage from the umbrella shade while allowing for hands-free accessibility under the umbrella to the user.

The handle includes a latch adapted to retract the connector joint and attachment device from within. The latch is designed to be operable with an automatic single finger quick release, for example.

The handle includes a quick release to automatically raise the umbrella rib structure and attached shade for use. The quick release mechanism provides a rapid means by which to raise and extend a collapsed or unextended umbrella.

In at least one embodiment, the umbrella also includes a light attachment to provide the bearer of the umbrella with illumination. In at least one embodiment, the light includes a shaft light, illuminating upwardly. In at least one embodiment, the light includes a shade frame light, illuminating downwardly. The number of lights and the amount of light illuminated from each light can vary. Additionally, lights of varied and multiple colors can be utilized in various embodiments.

The umbrella described herein is useful in a multiplicity of circumstances, such as, by way of example, the following: loading groceries or shopping bags inside a car or trunk of a car, helping mothers with small children while the enter a car seat or adjusting a seat belt, putting strollers in a car or trunk, assisting caregiver with a handicapped person and chair, handling a briefcase of purse when entering or exiting a car, freeing up hands to operate a phone or locate keys, or the like, changing a flat tire, checking under the hood of a car, at a sporting event, or the like, when nearby a car, car camping, and tailgate parties.

Advantageously, the technology described herein provides for the hands free operation of an umbrella. Also advantageously, the umbrella described herein provides for a multiplicity of angle, pivot, and rotation configurations for varied use. Further advantageously, the umbrella described herein provides for ventilation. Still further advantageously, the umbrella described herein provides illumination.

DETAILED DESCRIPTION

Figure 1:
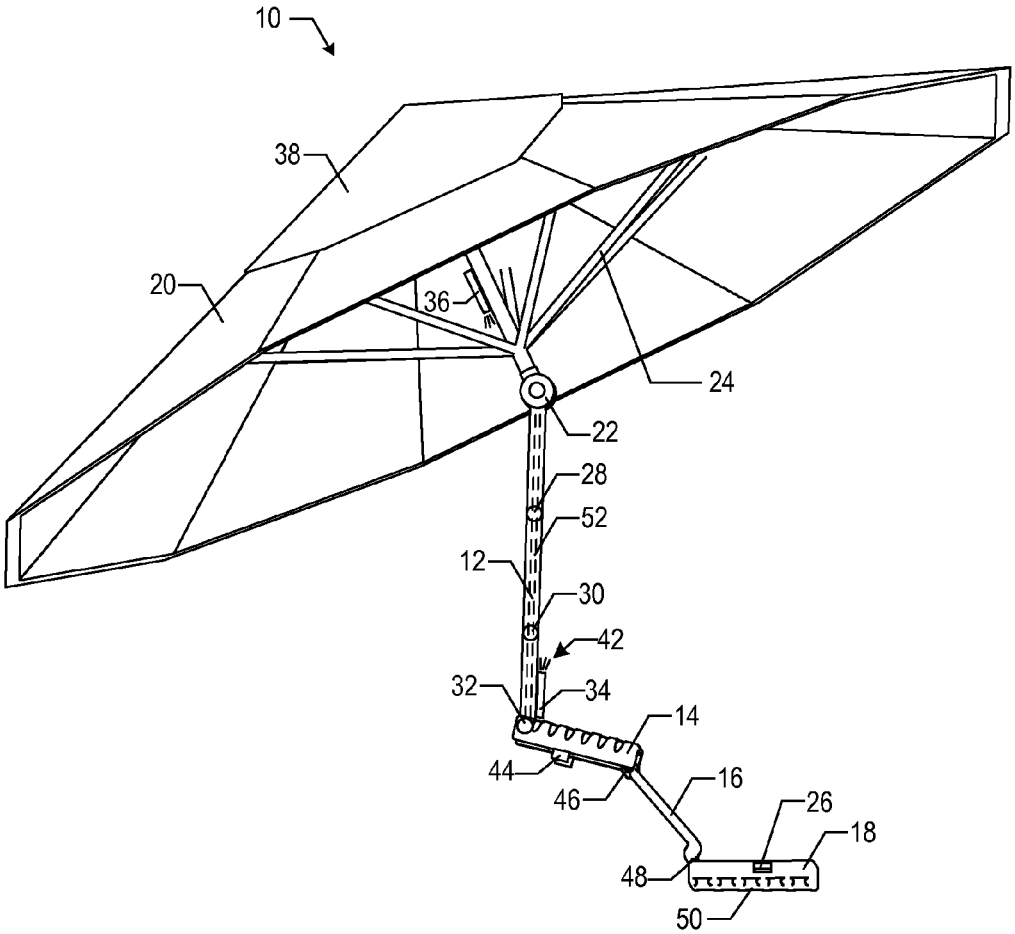
FIG. 1 is a left front perspective view of an umbrella assembly, illustrating, in particular, the shaft, shade, grip, connector, base, pivot shade support frame, latch, upper shade, shaft light, and frame light according to an embodiment of the technology described herein.
Figure 2:
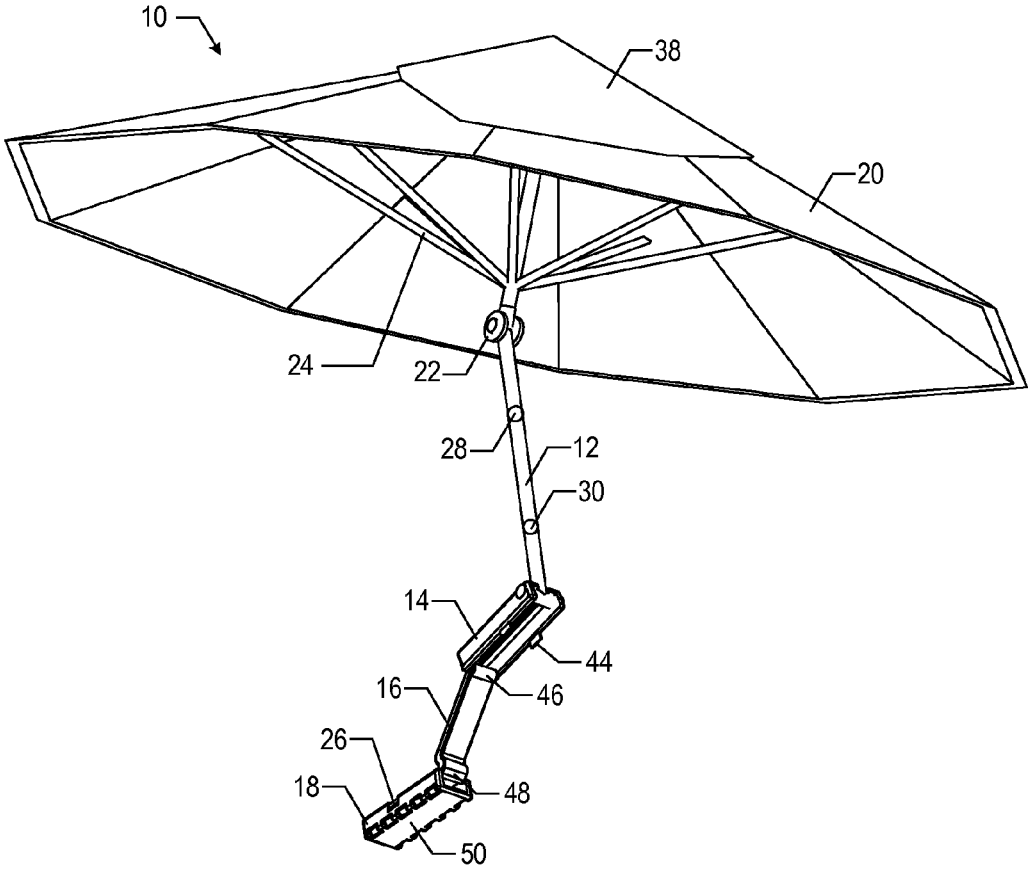
FIG. 2 is a right front perspective view of the umbrella assembly depicted in FIG. 1.
Figure 3:
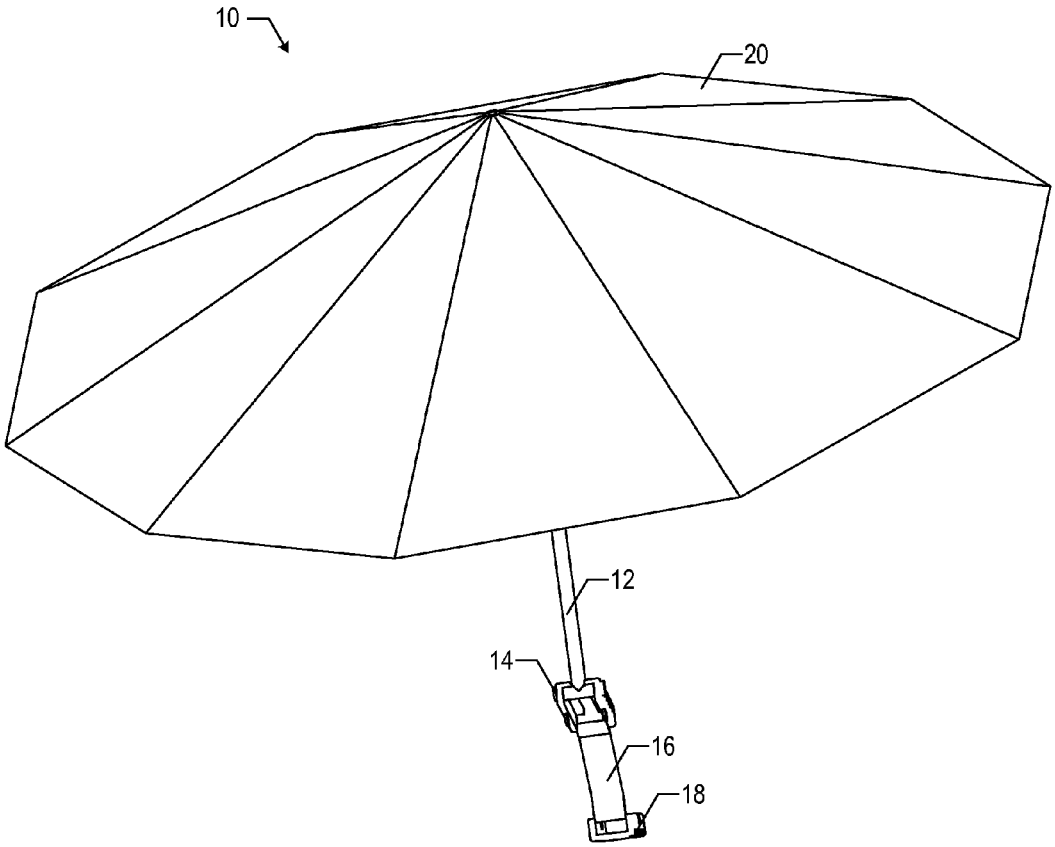
FIG. 3 is a top perspective view of the umbrella assembly depicted in FIG. 1.

In various exemplary embodiments, the technology described herein provides a lightweight, portable umbrella with an extensible, collapsible, and retractable handle grip and attachment device folded out from within adapted to interchangeably secure the umbrella to a surface to allow for hands-free operation while a user is beneath the umbrella in order to remain dry and shaded.

Referring now to the FIGS. 1 through 10, an umbrella 10 and various umbrella components are depicted. FIGS. 1 through 3, 8, and 9, specifically, each depict various views of an umbrella 10 having a shade or canopy 20, and in at least one embodiment, an upper shade 38 having a mesh ventilation panel 40 beneath it to provide ventilation. The canopy 20 is both extensible and collapsible. The canopy 20 is configured to provide shade from sun and protection from precipitation.

The umbrella 10 is designed to be used in a multiplicity of directions, angles, pivots, rotations, and the like, as selected by a user to allow the desired coverage from the umbrella shade 20 while allowing for hands-free accessibility under the umbrella 10 to the user. The umbrella 10 can be manufactured in a multiplicity of sizes.

The umbrella 10 includes a durable, lightweight shaft 12 supporting a rib structure 24, or canopy support frame. In at least one embodiment, the shaft 12 itself is extensible and retractable, through use of a center ball spring, or the like, to make it telescoping with extensible rod 52. Additionally, the shaft 12 can vary in length to produce umbrellas of varying lengths or heights. In at least one embodiment, the shaft is extensible by means of an internal extensible rod 52 which can be ejected to a certain length by the bearer of the umbrella 10. The extensibility in length can vary as selected by the user.

The shaft 12 is manufactured of a durable material sufficient to support the rib structure 24 and shade 20. Umbrellas known in the art use a runner device to push up and hold the rib structure 24 in place in an upright location while the umbrella is extended. The umbrella 10 described herein utilizes joints that can serve as a runner, but also provide additional functionality in tilt, rotation, and the like, options as is discussed in greater detail below. The shaft 12 is coupled to the canopy support frame 24 and the canopy 20. The shaft 12 is extensible from the closed position to the open position. An angle of the canopy 20 and canopy support frame 24, relative to the shaft 12, is adjustable;

Shades 20 are already known in the art, and, for example, can include a strong fabric material that is waterproof to shade the bearer of the umbrella from rain, sunlight, wind, and the like. The canopy or shade 20 can vary in size as well. By way of example, the shade 20 can be of a smaller diameter when extended to accommodate a child. The shade 20 can be of a larger diameter when extended to accommodate a taller adult or even multiple persons. The shade 20 can include multiple tiers 20, 38.

Additionally, the shade 20, in at least one embodiment, includes a ventilation portion. The ventilation portion is, for example, a mesh-like material 40 with holes near the top portions of the shade 20, closest to the shaft 12. In such an embodiment, an upper tier shade 38, or upper canopy, can cover the ventilation area 40. Furthermore, the shade 20 can include ventilation holes 40 in order to allow passage of air, such that the shade 20 still provides cover from rain and wind, yet wind passes through the ventilation holes so as to not blow the umbrella 10 away.

The shade 20 is supported by a structural support frame, stretcher, or rib structure 24. The rib structure 24 is collapsible to accommodate folding of the umbrella 10 when not in use. The rib structure 24 can be manufactured from a durable, lightweight material such as metal or a strong plastic.

The canopy support frame 24, or rib structure, includes multiple radially disposed support ribs attached to an underside of the canopy. The support ribs are upwardly extensible from a closed position to an open position and retractable from the open position to the closed position;

The rib structure 24 is coupled to the umbrella shaft 12 at a pivot and/or rotation point 22. As depicted specifically in FIG. 7, the umbrella 10 includes at least one pivot and/or rotation point 22. In alternative embodiments more than one pivot and/or rotation point 22 is utilized to provide even greater combinations in use. The pivot and/or rotation points 22 provide for umbrella 10 use in a multiplicity of directions, angles, pivots, rotations, and the like, as selected by a user to allow the desired coverage from the umbrella shade 20 while allowing for hands-free accessibility under the umbrella 10 to the user.

The pivot and/or rotation point 22 allows for pivoting in a two-dimensional plane, or rotation in a three-dimensional plane. By way of example, a pivot is provided when the umbrella shade 20 and rib structure 24 as a whole can be moved back and forth. Also by way of example, a rotation is provided wherein the umbrella shade 20 and rib structure 24 as a whole can rotate, such as in a ball and socket joint.

Figure 4:
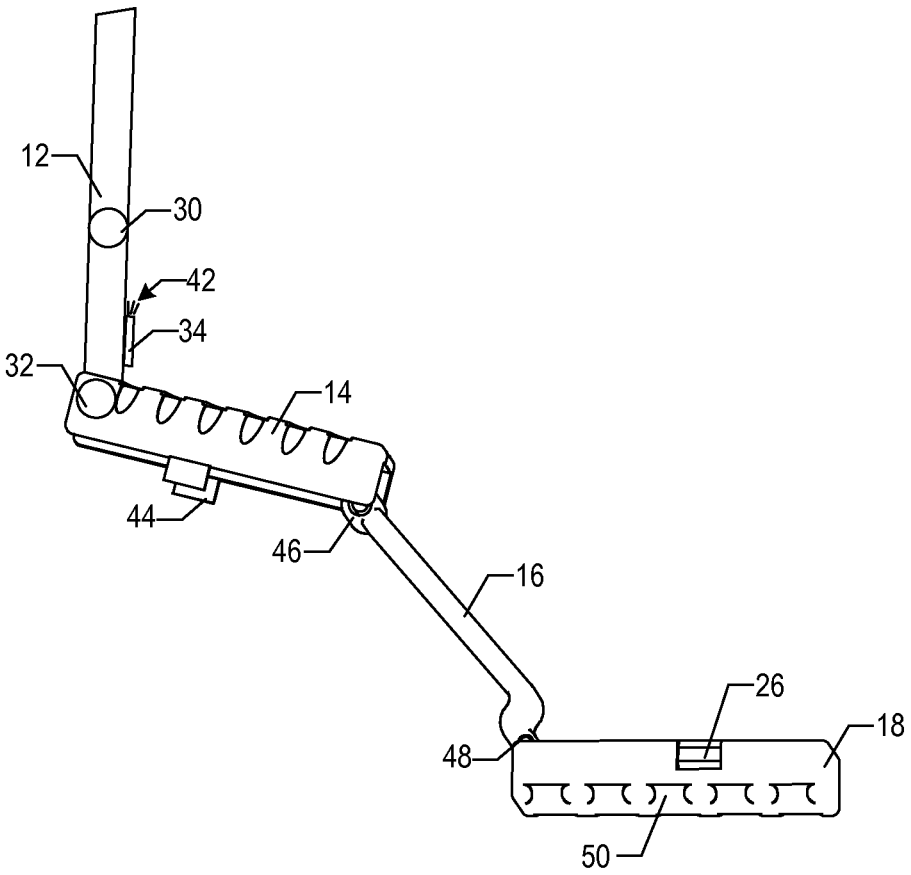
FIG. 4 is a close-up perspective view of the shaft, grip, connector, base and latch of the umbrella assembly depicted in FIG. 1.
Figure 5:
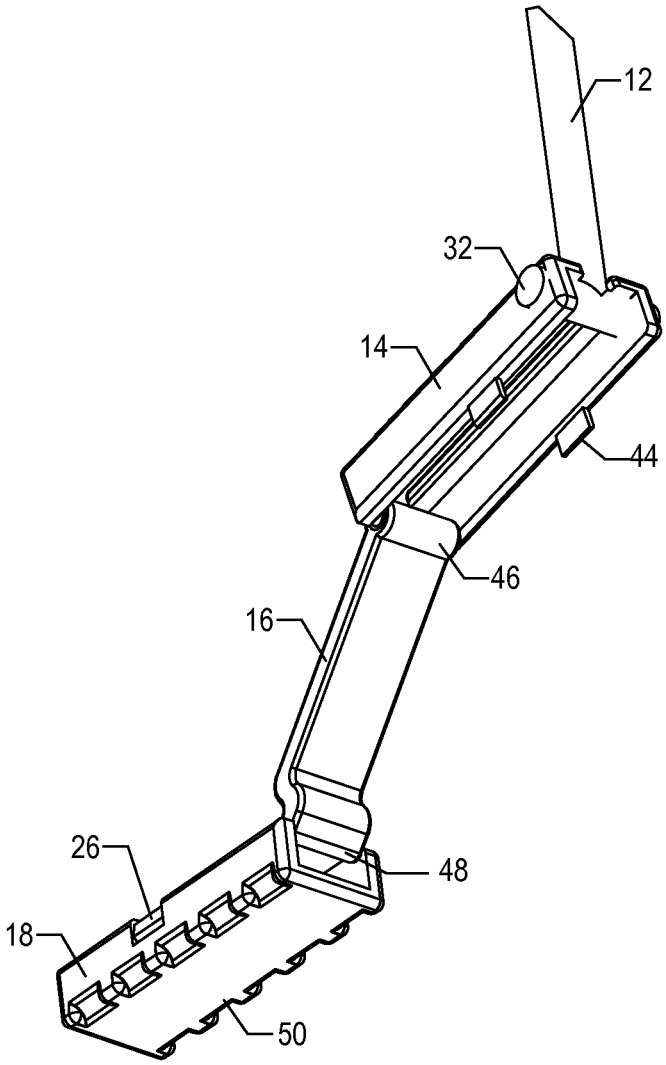
FIG. 5 is a close-up perspective view of the shaft, grip, connector, base and latch of the umbrella assembly depicted in FIG. 1.
Figure 6:
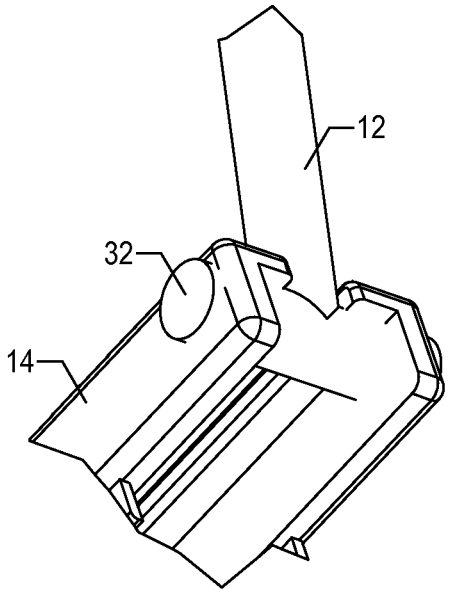
FIG. 6 is a close-up perspective view of the shaft and grip of the umbrella assembly depicted in FIG. 1.
Figure 7:
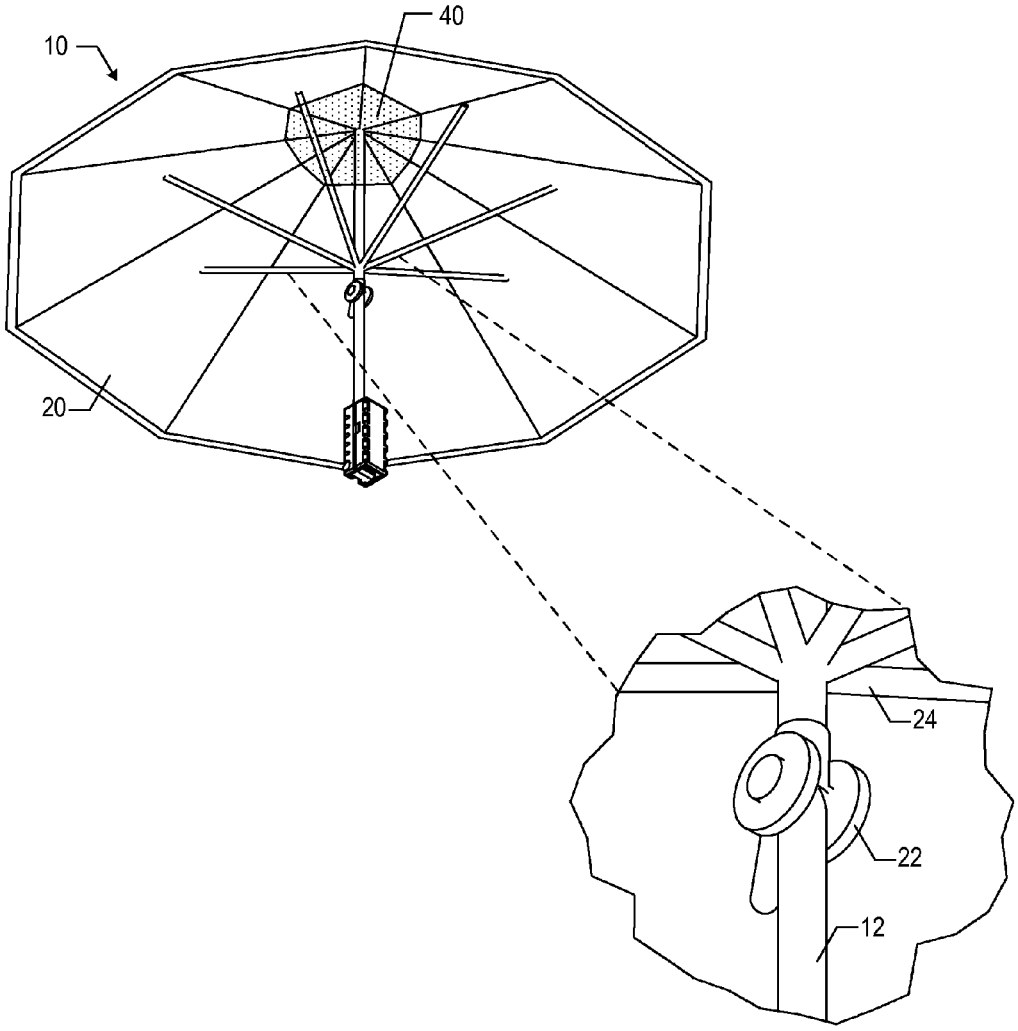
FIG. 7 is a close-up perspective view of the pivot of the umbrella assembly depicted in FIG. 1.
Figure 8:
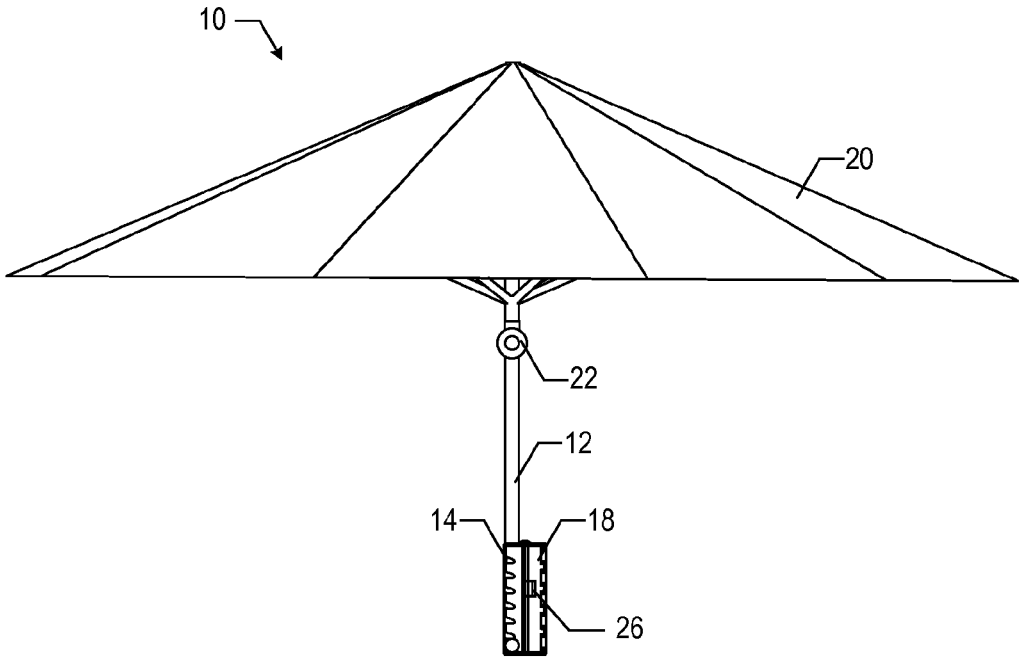
FIG. 8 is a side planar view of the of the umbrella assembly depicted in FIG. 1.
Figure 9:
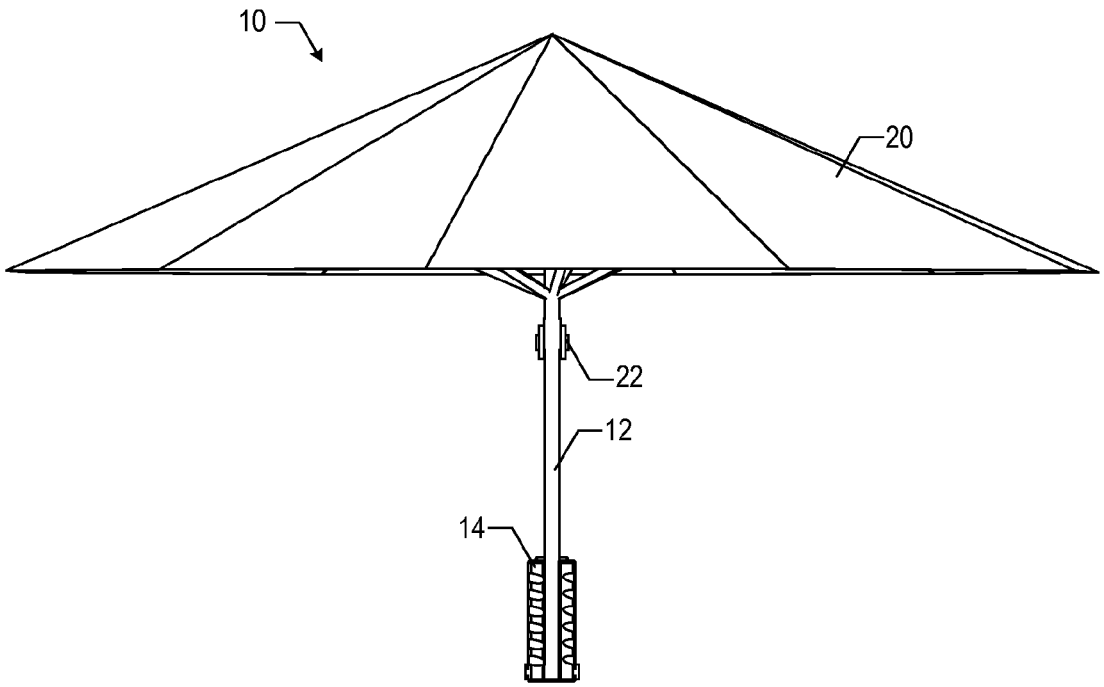
FIG. 9 is a rear planar view of the umbrella assembly depicted in FIG. 1.
Figure 10:
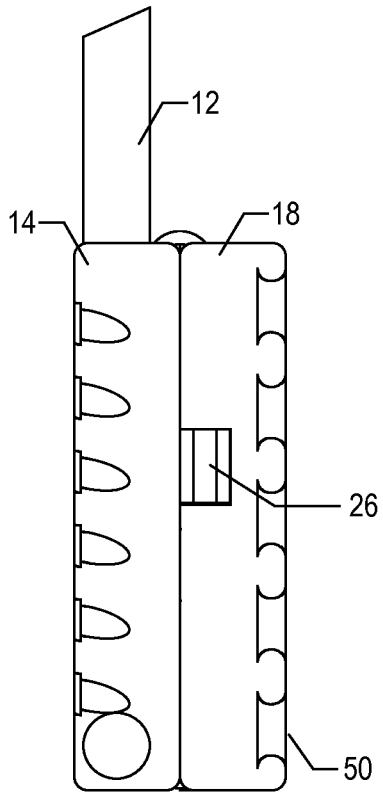
FIG. 10 is a side planar view of the grip, base, and latch of the umbrella assembly depicted in FIG. 1.

As depicted specifically in FIGS. 4 and 5, the umbrella 10 includes a handle 14, or grip, that is retractable from the shaft 12. FIG. 6, specifically, shows the attachment of the handle 14 to the shaft 12. The handle 14 is coupled to the shaft 12. The handle 14 is held by an operator holding the umbrella assembly and operably extending and retracting the shaft 12, canopy support frame 24, and shaft 12.

By way of example, the handle 14 can rotate relative to an axis perpendicular to the shaft 12. The handle 14 can include grip formations to aid in gripping by the bearer of the umbrella. When the handle 14 and base 18, which serves as an attachment device, are not extended the umbrella 10 functions similar to a traditional umbrella in which a user grasps the handle to hold the umbrella in an upright manner.

As the handle 14 is retracted, a connector joint 16 and base 18, such as a magnet which serves as an attachment device, is revealed and retracted. The magnet 18 is utilized, for example, to temporarily secure the umbrella 10 to a metallic surface such as one on a car. Alternative bases 18, in addition to magnets and which serve as an attachment device, such as suction devices, to retract from the handle 14 are anticipated.

In at least one embodiment, the umbrella 10 includes a base 18 coupled to the handle 14 and extensible from the handle 14, wherein the base 18 extends and retracts from the handle 14; and a base fastener 50 disposed upon the base 18, and thereby extensible from the handle 14, wherein the base fastener 50 is configured to interchangeably and temporarily secure the umbrella 10 to another surface apart from the umbrella assembly in order to provide temporarily the operator with a hands-free operation of the umbrella.

In at least one embodiment, the umbrella 10 includes a connector joint 16 configured to couple the base 18 to the handle 14 and to allow for the extensibility and retractability of the base 18 from the handle 14; a grip pivot 46 to couple the connector to the grip and to provide for a first pivot such that the base is extended from the grip; and a base pivot 48 to couple the connector joint 16 to the base 18 and to provide for a second pivot such that the base 18 is extended from the handle 14.

In use, the umbrella 10 remains stationary at a desired placement angle and direction while anchored by the base 18 to a surface, as a means for attachment. For example, the base 18 is unfolded from handle 14 and placed on the surface of a car. There the umbrella 10 remains in place, and hands-free, so that the operator may carry on other tasks with both hands free from the need to hold the umbrella 10.

The retraction of the handle 14, connector joint 16, and base 18 provides a multiplicity of additional pivot capabilities and angles of use for the umbrella once mounted.

The handle 14 includes at least one latch 44 disposed upon the handle 14, the latch 44 configured to securely couple the base 18 to the handle 14 when the handle 14 is not extended. The base 18 includes a latch receiver 26 adapted to retract the connector joint 16 from within. The latch receiver 26 is designed to be operable with an automatic single finger quick release, for example. At least one latch receiver 26 is disposed upon the base 18. The latch receiver 26 is configured to securely receive the latch 44 and secure the base 18 to the handle 14 when the handle 14 is not extended.

In at least one embodiment, the umbrella 10 includes a swivel joint 32 configured to couple the handle 14 to the shaft 12 and to allow the handle 14 to swivel and pivot about the shaft 12 when the handle 14 is operably released to allow movement of the handle 14 about the shaft and to hold the handle 14 in place relative to the shaft 12 once a desired angle and grip location is determined for use.

In at least one embodiment, the umbrella 10 includes at least one shaft joint 28, 30 disposed within the shaft 12. Each shaft joint 28, 30 is configured to allow movement of a first portion of the shaft 12 relative to a second portion of the shaft 12 and to hold the first and second portions of the shaft in place relative to one another once a desired angle and shaft location is determined for use.

In at least one embodiment, the at least one shaft joint further includes an upper shaft joint 28 and a lower such joint 30. In this embodiment, the shaft 12 further comprises a third portion, such that the first, second, and third shaft portions are moveable and adapted to lock in place relative to one another once a desired angle and shaft location is determined for use.

In at least one embodiment, the umbrella 10 includes a pivot and/or rotation point 22. The pivot and/or rotation point 22 is disposed upon the canopy support frame 24 and is configured to couple the canopy support frame 24 to the shaft 12 and adapted to lock in place once a desired canopy angle and canopy location is determined for use.

In at least one embodiment, the umbrella 10 includes a shaft light 34 disposed upon the shaft and configured to provide illumination 42 upwardly from the shaft 12. This illumination provides a user of the umbrella 10 with indirect light above.

In at least one embodiment, the umbrella 10 includes a canopy support frame light 36 disposed upon the canopy support frame and configured to provide illumination downwardly from the canopy support frame. This illumination provides a user of the umbrella 10 with direct light coming downwardly from above.

The handle 14 includes a quick release to automatically raise the umbrella rib structure and attached shade for use.

In at least one embodiment, the umbrella 10 also includes a light attachment to provide the bearer of the umbrella with illumination.

It is to be understood that the disclosure teaches just one example of the illustrative embodiment and that many variations of the invention can easily be devised by those skilled in the art after reading this disclosure and that the scope of the present invention is to be determined by the claims.

What is claimed is:

1. An umbrella assembly comprising:

a canopy, wherein the canopy is extensible and collapsible and is configured to provide shade from sun and protection from precipitation;

a canopy support frame comprised of a plurality of radially disposed support ribs attached to an underside of the canopy, wherein the support ribs are upwardly extensible from a closed position to an open position and retractable from the open position to the closed position;

a shaft coupled to the canopy support frame and canopy, wherein the shaft is extensible from the closed position to the open position, and wherein an angle of the canopy and canopy support frame, relative to the shaft, is adjustable;

a grip coupled to the shaft by which an operator holds the umbrella assembly and operably extends and retracts the shaft, canopy support frame, and canopy;

a base coupled to the grip and extensible from the grip, wherein the base extends and retracts from the grip, and wherein the base is integrally formed with the grip in the form of an umbrella handle when the base is not extended;

a base fastener disposed upon the base, and thereby extensible from the grip, wherein the base fastener is configured to interchangeably and temporarily secure the umbrella to another surface apart from the umbrella assembly in order to provide the operator with a hands-free operation of the umbrella temporarily;

a connector joint configured to couple the base to the grip and to allow for the extensibility and retractability of the base from the grip;

a grip pivot to couple the connector to the grip and to provide for a first pivot such that the base is extended from the grip;

a base pivot to couple the connector to the base and to provide for a second pivot such that the base is extended from the grip;

at least one latch disposed upon the grip, the latch configured to securely couple the base to the grip when the base is not extended; and at least one latch receiver disposed upon the base, the latch receiver configured to securely receive the latch and secure the base to the grip when the base is not extended.

2. The umbrella assembly of claim 1, further comprising:

a swivel joint configured to couple the grip to the shaft and to allow the grip to swivel and pivot about the shaft when the grip is operably released to allow movement of the grip about the shaft and to hold the grip in place relative to the shaft once a desired angle and grip location is determined for use.

3. The umbrella assembly of claim 1, further comprising:

at least one shaft joint disposed within the shaft and configured to allow movement of a first portion of the shaft relative to a second portion of the shaft and to hold the first and second portions of the shaft in place relative to one another once a desired angle and shaft location is determined for use.

4. The umbrella assembly of claim 3, wherein the at least one shaft joint further comprises an upper shaft joint and a lower such joint, and wherein the shaft further comprises a third portion, such that the first, second, and third shaft portions are moveable and adapted to lock in place relative to one another once a desired angle and shaft location is determined for use.

5. The umbrella assembly of claim 1, further comprising:

a pivot and/or rotation point disposed upon the canopy support frame and configured to couple the canopy support frame to the shaft and adapted to lock in place once a desired canopy angle and canopy location is determined for use.

6. The umbrella assembly of claim 1, further comprising:

an extensible rod disposed within the shaft and extensible outwardly from the shaft to extend a height of the canopy.

7. The umbrella assembly of claim 1, further comprising:

a shaft light disposed upon the shaft and configured to provide illumination upwardly from the shaft.

8. The umbrella assembly of claim 1, further comprising:

a canopy support frame light disposed upon the canopy support frame and configured to provide illumination downwardly from the canopy support frame.

9. The umbrella assembly of claim 1, further comprising:

an upper canopy disposed above the canopy to provide a ventilation pathway to the underside of the canopy.

10. The umbrella assembly of claim 9, further comprising:

a mesh panel section disposed upon the canopy in an area of the canopy covered by the upper canopy to provide the ventilation pathway to the underside of the canopy.

11. The umbrella assembly of claim 1, wherein the base fastener is a magnet.

12. The umbrella assembly of claim 1, wherein the base fastener is a suction mount.

13. An umbrella assembly comprising:

a canopy, wherein the canopy is extensible and collapsible and is configured to provide shade from sun and protection from precipitation;

a canopy support frame comprised of a plurality of radially disposed support ribs attached to an underside of the canopy, wherein the support ribs are upwardly extensible from a closed position to an open position and retractable from the open position to the closed position;

a shaft coupled to the canopy support frame and canopy, wherein the shaft is extensible from the closed position to the open position, and wherein an angle of the canopy and canopy support frame, relative to the shaft, is adjustable;

a grip coupled to the shaft by which an operator holds the umbrella assembly and operably extends and retracts the shaft, canopy support frame, and canopy;

a shaft light disposed upon the shaft and configured to provide illumination upwardly from the shaft;

a base coupled to the grip and extensible from the grip, wherein the base extends and retracts from the grip, and wherein the base is integrally formed with the grip in the form of an umbrella handle when the base is not extended; and a base fastener disposed upon the base, and thereby extensible from the grip, wherein the base fastener is configured to interchangeably and temporarily secure the umbrella to another surface apart from the umbrella assembly in order to provide the operator with a hands-free operation of the umbrella temporarily.

14. The umbrella assembly of claim 13, further comprising:

a canopy support frame light disposed upon the canopy support frame and configured to provide illumination downwardly from the canopy support frame.

15. An umbrella assembly comprising:

a canopy, wherein the canopy is extensible and collapsible and is configured to provide shade from sun and protection from precipitation;

a canopy support frame comprised of a plurality of radially disposed support ribs attached to an underside of the canopy, wherein the support ribs are upwardly extensible from a closed position to an open position and retractable from the open position to the closed position;

a shaft coupled to the canopy support frame and canopy, wherein the shaft is extensible from the closed position to the open position, and wherein an angle of the canopy and canopy support frame, relative to the shaft, is adjustable;

a grip coupled to the shaft by which an operator holds the umbrella assembly and operably extends and retracts the shaft, canopy support frame, and canopy;

a base coupled to the grip and extensible from the grip, wherein the base extends and retracts from the grip, and wherein the base is integrally formed with the grip in the form of an umbrella handle when the base is not extended;

a base fastener disposed upon the base, and thereby extensible from the grip, wherein the base fastener is configured to interchangeably and temporarily secure the umbrella to another surface apart from the umbrella assembly in order to provide the operator with a hands-free operation of the umbrella temporarily;

an upper canopy disposed above the canopy to provide a ventilation pathway to the underside of the canopy;

a mesh panel section disposed upon the canopy in an area of the canopy covered by the upper canopy to provide a ventilation pathway to the underside of the canopy;

a grip pivot to couple a connector to the grip and to provide for a first pivot such that the base is extended from the grip; and a base pivot to couple the connector to the base and to provide for a second pivot such that the base is extended from the grip.

16. The umbrella assembly of claim 15, further comprising:

a connector configured to couple the base to the grip and to allow for the extensibility and retractability of the base from the grip;

at least one latch disposed upon the grip, the latch configured to securely couple the base to the grip when the base is not extended; and at least one latch receiver disposed upon the base, the latch receiver configured to securely receive the latch and secure the base to the grip when the base is not extended.

17. The umbrella assembly of claim 15, further comprising:

a swivel joint configured to couple the grip to the shaft and to allow the grip to swivel and pivot about the shaft when the grip is operably released to allow movement of the grip about the shaft and to hold the grip in place relative to the shaft once a desired angle and grip location is determined for use; and at least one shaft joint disposed within the shaft and configured to allow movement of a first portion of the shaft relative to a second portion of the shaft and to hold the first and second portions of the shaft in place relative to one another once a desired angle and shaft location is determined for use, wherein the at least one shaft joint further comprises an upper shaft joint and a lower such joint, and wherein the shaft further comprises a third portion, such that the first, second, and third shaft portions are moveable and adapted to lock in place relative to one another once a desired angle and shaft location is determined for use.

* * * * *